US005589733A

United States Patent [19]

Noda et al.

[11] Patent Number: 5,589,733

[45] Date of Patent: Dec. 31, 1996

[54] ELECTROLUMINESCENT ELEMENT INCLUDING A DIELECTRIC FILM OF TANTALUM OXIDE AND AN OXIDE OF EITHER INDIUM, TIN, OR ZINC

[75] Inventors: Koji Noda, Nagoya; Hisayoshi Fujikawa; Katsuji Yamashita, both of Seto; Yasunori Taga, Nagoya, all of Japan

[73] Assignee: Kabushiki Kaisha Toyota Chuo Kenkyusho, Aichi-ken, Japan

[21] Appl. No.: 390,567

[22] Filed: Feb. 17, 1995

[30] Foreign Application Priority Data

Feb. 17, 1994 [JP] Japan ..... 6-020430

[51] Int. Cl.[6] ..... H01J 1/70

[52] U.S. Cl. ..... 313/509; 313/506; 313/498

[58] Field of Search ..... 313/498, 506, 313/509; 428/688, 690, 917

[56] References Cited

U.S. PATENT DOCUMENTS

| | | | |
|---|---|---|---|
| 4,670,355 | 6/1987 | Matsudaira | 313/509 |
| 4,702,980 | 10/1987 | Matsuura et al. | 430/63 |
| 5,270,267 | 12/1993 | Ouellet | 437/231 |
| 5,306,547 | 4/1994 | Hood et al. | 428/213 |
| 5,404,075 | 4/1995 | Fujikawa et al. | 313/509 |
| 5,480,722 | 1/1996 | Tomonaga et al. | 428/428 |

*Primary Examiner*—Michael Horabik
*Assistant Examiner*—Michael Day
*Attorney, Agent, or Firm*—Oblon, Spivak, McClelland, Maier & Neustadt, P.C.

[57] ABSTRACT

Electroluminescent element includes two dielectric layers disposed on either side of a luminescent layer wherein a transparent electrode and a backing electrode are formed on respective dielectric layers. In a preferred embodiment, the dielectric films include tantalum oxide and at least one oxide of either indium, tin, or zinc wherein the total content of the indium, tin, and zinc atoms in the dielectric layer comprise 55 atomic % or less with respect to the total content of tantalum, indium, tin, and zinc atoms. The dielectric films have a relatively high dielectric constant and high breakdown strength.

16 Claims, 16 Drawing Sheets

ELECTROLUMINESCENT ELEMENT INCLUDING A DIELECTRIC FILM OF TANTALUM OXIDE AND AN OXIDE OF EITHER INDIUM, TIN, OR ZINC

FIELD OF THE INVENTION

The present invention relates to a dielectric film which includes tantalum oxide as a major component. The dielectric film can be utilized in electronic devices, display devices, light-control devices, etc. The present invention also relates to an electroluminescent element (hereinafter abbreviated to "EL") which employs the dielectric film.

DESCRIPTION OF THE RELATED ART

As the technologies of LSI, display, and the like have developed recently, there has arisen the ever-increasing need for a film which is of high dielectric constant and of high insulatability. For example, a film is applied to capacitors which are of high dielectric constant for downsizing LSIs, to enlargement of displays, to insulator films which are of high dielectric constant and of high reliability, and so on. In particular, a transparent insulator film having a high dielectric constant is prepared on a transparent substrate and a functional film is further formed on the top surface of the transparent insulator film, and thereby the transparent insulator film has been often applied to a display device in which characters appear to be projected on a transparent glass screen, or to a light-control device which controls intensity of light which transmits through a glass shield. In the field of such devices, especially in the filed of EL display devices, thin film which is of higher dielectric constant and of higher insulatability is required particularly.

Thin film EL elements, especially whole-solid type thin film EL elements, are not only superior in durability, but also they are good display elements which are self-luminous and excellent in terms of visibility. Hence, they are put into a practical application as flat panel display devices. In addition, when thin film EL elements are used together with a pair of transparent conductive films working as electrodes, they can be constructed as transmission type light-emitting devices. Thus, thin film EL elements are very desirable light-emitting elements which are expected to be put into various applications.

Due to operational principle of thin film EL elements, however, high electric field of alternating current should be applied to them. Accordingly, in thin film EL elements, there arises a problem in that their life expectancy is affected by dielectric breakdown of high-dielectric-constant insulator layers. To put it differently, when a thin film is prepared to have high dielectric constant and high insulatability, thin film EL elements can enjoy long life and emit light stably and efficiently. As a result, such thin film EL elements enable to improve yield in manufacturing processes of finished products and to enlarge light-emitting surface thereof.

The aforementioned conventional thin film EL elements have employed insulator films which are made from silicon dioxide, alumina, silicon nitride or yttrium oxide. These insulator films are of low relative dielectric constant, and consequently they inhibit applying effective voltage to luminous layers. Accordingly, there arises a problem in that high operational voltage cannot be applied to conventional thin film EL elements.

Tantalum oxide has a relative dielectric constant which is from 5 to 6 times larger than that of silicon oxide. Hence, it has been tried to prepare insulator films of thin film EL elements by using tantalum oxide. When an insulator film made from tantalum oxide is laminated with a transparent electrode, e.g., an ITO (i.e., indium-tin oxide) electrode, the insulator film exhibits considerably degraded dielectric breakdown strength. Therefore, in Japanese Unexamined Patent Publication (KOKAI) No. 50-27,488, Japanese Unexamined Patent Publication (KOKAI) No. 54-44,885, Japanese Unexamined Patent Publication (KOKAI) No. 56-52,438 and Japanese Unexamined Patent Publication (KOKAI) No. 58-216,391, there are proposed novel processes in which a thin film made from silicon dioxide, alumina, silicon nitride or yttrium oxide is interposed at the boundary between the tantalum oxide insulator film and the transparent conductive film, thereby preparing a multi-layered insulator layer. However, the multi-layered insulator layers can scarcely give appreciable advantage as expected, and they have complicated manufacturing processes.

Further, as set forth in Japanese Unexamined Patent Publication (KOKAI) No. 4-366,504, yttrium oxide or tungsten oxide is added to a dielectric thin film made from tantalum oxide in order to enhance dielectric breakdown strength thereof. By this attempt, dielectric breakdown strength of the dielectric thin film per se can be upgraded. However, even by this attempt, it is impossible to solve the problem of drastic decrease in dielectric breakdown strength which stems from the lamination of the dielectric thin film with on a transparent conductive film (e.g., an ITO transparent conductive film).

Furthermore, Japanese Unexamined Patent Publication (KOKAI) No. 6-32,617 discloses a sputtering target for forming an insulator film. The sputtering target is a sintered substance of a composite oxide which consists essentially of at least one component selected from the group consisting of titanium oxide, barium oxide, hafnium oxide, yttrium oxide, zirconium oxide, niobium oxide, aluminum oxide, zinc oxide, silicon oxide and beryllium oxide in an amount of from 1 to 30% by weight, and the balance of tantalum oxide, and the sintered substance has a sintered density of 80% or more. This publication indicates that zinc oxide can be composited with tantalum oxide, and it indeed discloses preferred embodiments which relate to a sintered body of a composite oxide employing oxides other than zinc oxide. However, the publication does not recite a preferred embodiment which relates to a sintered body of a composite oxide employing zinc oxide.

SUMMARY OF THE INVENTION

The present invention has been developed in view of the aforementioned circumstances. It is therefore an object of the present invention to provide a novel dielectric film which is single-layered, not multi-layered, which is of high relative dielectric constant, and which can be laminated with a transparent conductive film without suffering from a deteriorated dielectric breakdown strength. It is another object of the present invention to provide a thin film EL element which employs the novel dielectric thin film.

The inventors of the present invention assumed that, when a tantalum oxide thin film is laminated with a transparent conductive film, it suffers from a deteriorated dielectric breakdown strength because oxygen atoms or metallic atoms diffuse into a deletion layer which is present in the tantalum oxide thin film, or because oxygen atoms present in the tantalum oxide thin film diffuse into the transparent conductive film. In order to inhibit these diffusions, they supposed that the deletion layer can be stabilized by adding some other elements to tantalum oxide, and that the oxygen atoms present in the tantalum oxide thin film can be inhibited from diffusing thereby. Moreover, they noticed that it is necessary for them to pay attention to the component elements which are employed in the transparent conductive film. Based on these assumptions, they discovered that, when tantalum oxide is compounded with at least one oxide selected from the group consisting of indium oxide, tin oxide and zinc oxide to prepare a thin film, the resulting thin film is superior in insulatability, and it is of high dielectric constant. In this way, they completed the present invention.

A dielectric film according to the present invention comprises:

tantalum oxide; and at least one member selected from the group consisting of indium oxide, tin oxide and zinc oxide being incorporated in the tantalum oxide, the dielectric film being formed as a thin film.

The thickness of the film is not limited specifically, but is generally less than 30,000 angstroms (i.e., 3 micrometers). A film of 300 to 15,000 angstroms (i.e., 0.03 to 1.5 micrometers) has been confirmed to be fully effective, and a film of 1,000 to 5,000 angstroms (i.e., 0.1 to 0.5 micrometers) is practically important and effective.

An electroluminescent element according to the present invention comprises:

a luminous layer having opposed surfaces;

a first dielectric layer coated on one of the opposed surfaces; and a second dielectric layer coated on the other of the opposed surfaces;

a transparent electrode disposed on the first dielectric layer; and a backing electrode disposed on the second dielectric layer, at least one of the first and second dielectric layers comprising tantalum oxide, and at least one member selected from the group consisting of indium oxide, tin oxide and zinc oxide being incorporated in the tantalum oxide, said at least one of the first and second dielectric layers being formed as a thin film.

The present dielectric film is made from the tantalum oxide in which at least one member selected from the group consisting of indium oxide, tin oxide and zinc oxide (e.g., $In_2O_3$, $SnO_2$ and ZnO) is incorporated, and it is formed as a thin film. Although a dielectric film made from simple tantalum oxide has a high dielectric breakdown strength (or electric field), a laminated construction comes to exhibit a sharply degraded dielectric breakdown strength when a transparent conductive film and the simple tantalum oxide dielectric film are laminated. On the other hand, the present dielectric film comprises the special tantalum oxide in which at least one member selected from the group consisting of $In_2O_3$, $SnO_2$ and ZnO is incorporated. Accordingly, it has a relative dielectric constant identical with that of the simple tantalum oxide dielectric film, and it is improved in terms of dielectric breakdown strength. In addition, even when it is laminated with a transparent conductive film, the resulting laminated construction hardly suffers from a deteriorated dielectric breakdown strength.

In the present tantalum oxide dielectric film with the aforementioned additive members incorporated, the composition does not vary greatly depending on the additive members to be incorporated. For instance, with respect to the total content of tantalum atoms, indium atoms, tin atoms and zinc atoms in $Ta_2O_5$, $In_2O_3$, $SnO_2$ and ZnO constituting the present dielectric film, it is preferred to add at least one of the indium atoms, the tin atoms and the zinc atoms (hereinafter simply referred to as "additive components") to simple tantalum oxide in the total content of 55.0 atomic % or less. When tantalum oxide incorporates at least one of the additive components in the total content of more than 55.0 atomic %, the resulting films are affected by the additive components so that they may be unpreferably degraded in terms of relative dielectric constant and dielectric breakdown strength. In particular, it is further preferred to add at least one of the additive components to simple tantalum oxide in the total content of from 0.4 to 45.0 atomic %. When tantalum oxide incorporates at least one of the additive components in such a range, the present dielectric film has a high relative dielectric constant and exhibits a large dielectric breakdown field. Two or more of the additive components, e.g., ITO (i.e., indium-tin oxide), may be added to simple tantalum oxide. If such is the case, when two or more of the additive components are added in the total content of 55.0 atomic % or less, they produce similar advantages which result from the addition of one additive component alone. Unless otherwise specified, the atomic % herein means a ratio of the total content of the metallic atoms, included in the specific metallic oxides, with respect to a total content of the metallic atoms, constituting the present dielectric film.

The present dielectric film can be prepared by using either one of the following processes: a PVD (physical vapor deposition) process, a CVD (chemical vapor deposition) process, and a wet film-forming process like a sol-gel process. Although the following descriptions are not intended to limit the process for adding the above-described additive components, it is preferred to employ a process which enables to uniformly add the additive components to the tantalum oxide film. For example, it is further preferred to employ a PVD process for preparing the present dielectric film. Among PVD processes, it is furthermore preferred to employ a magnetron sputtering process. Namely, according to a magnetron sputtering process, it is possible to use an apparatus in which a plurality of evaporation sources are provided, to control the composition of the resulting film with considerable ease, and to densely form the resulting film. As for the film-forming conditions, they are not limited to the conditions associated with the processes listed above. Namely, it is preferred to select conditions which enable to densify the resulting film. For instance, it is preferred to control the pressure as low as possible during the formation of film.

The present EL element can be applied, for example, to an EL element which comprises a luminous layer having opposed surfaces, dielectric layers coated on the opposed surfaces, a transparent electrode disposed on one of the dielectric layers, and a backing electrode disposed on the other of the dielectric layers. The luminous layer can be made from a known inorganic or organic luminous layer. On dielectric layers laminated on the luminous layer, there are formed the transparent electrode on one of the opposed surfaces, and the backing electrode on the other of the opposed surfaces. The transparent electrode is formed so as to coat the dielectric layer.

As for the transparent electrode laminated on the dielectric layer, it is possible to employ a transparent electrode which is formed of ITO (indium-tin oxide), $SnO_2$ (nesa glass), or AZO (aluminum-zinc oxide). The present dielectric film can be laminated on either one of the transparent electrodes, and thereby a laminated body can be formed whose insulatability is little deteriorated by laminating. Further, when preparing a reflection type EL element in which either one of the electrodes (illustrated in FIG. 1) is formed of a transparent conductive film, a non-transparent electrode can substitute the transparent electrode. Furthermore, when preparing a transmission type EL element in which both of the electrodes (illustrated in FIG. 1) are formed of transparent conductive films, both of the transparent electrode and the backing electrode can be formed of transparent electrodes.

The present dielectric film can be applied unlimitedly to any EL element as far as a dielectric film and a transparent conductive film are laminated therein. For instance, it is applied to a whole-solid type EL element in which all of the components are formed of inorganic compounds, or to an EL element whose luminous layer employs an organic film.

Moreover, the applications of the present dielectric film are hardly limited to the aforementioned applications. For example, the present dielectric film can be used as a capacitor film for LSI. Namely, the present dielectric film can make a capacitor having a high capacity and exhibiting a high dielectric breakdown strength which is formed on LSI, thereby downsizing LSI.

The present dielectric film is formed by incorporating at least one member selected from the group consisting of indium oxide, tin oxide and zinc oxide (e.g., $In_2O_3$, $SnO_2$ and ZnO) in tantalum oxide. The incorporation of one of the additive members results in the stabilization of a dielectric film which is formed mainly of tantalum oxide. For instance, when the present dielectric film is laminated with a transparent conductive film, the resulting laminated construction scarcely suffers from a deteriorated relative dielectric constant and little exhibits a degraded dielectric breakdown strength. The reason lying behind the advantage is still under investigation, but it is believed as hereinafter described.

When tantalum oxide makes a film, the resulting film is not usually formed as complete crystal, but it includes oxygen deficiencies in its incomplete tantalum oxide crystal to produce a deletion layer, or it includes oxygen atoms or hydroxide groups resided therein. Under the circumstances, namely when a tantalum oxide film is free from the above-described additive members and when a high voltage is applied thereto, the dielectric breakdown strength of the tantalum oxide film is deteriorated by the deletion layer or the oxygen atoms and hydroxide groups present in tantalum oxide. Further, when a transparent conductive film such as an ITO film is prepared, it is usually formed to have a surface which is not flat at all but has many irregularities. When such a transparent conductive film is laminated with a tantalum oxide film, an electric field applied to the laminated body is likely to concentrate on the convexities on the surface of the transparent conductive film. Furthermore, the components of the transparent conductive film are caused to move into the tantalum oxide film, or the oxygen atoms and hydroxide groups present in the tantalum oxide film are even caused to move into the transparent conductive film. These movements of the components result in the increment in the electric resistance of the transparent conductive film (e.g., the ITO film), and cause to deteriorate the dielectric breakdown strength of the tantalum oxide film.

In the present dielectric film, the deletion layer in the tantalum oxide can be filled up completely by adding the aforementioned additive members. To put it differently, the components of the transparent conductive film can be inhibited from diffusing by adding them in the tantalum oxide film in advance. As a result, it is possible to keep the inherent relative dielectric constant of tantalum oxide, and to inhibit the dielectric breakdown strength thereof from degrading, or to even improve the dielectric breakdown strength.

The additive members to be added in simple tantalum oxide have been known as the components which constitute a transparent conductive film. However, it is still under investigation why the addition of these additive members produces the advantages.

As having been described so far, when an EL element is constituted by a construction in which the present dielectric film having a high dielectric constant is laminated with a transparent conductive film (or electrode), high insulatability can be maintained over the transparent conductive film. Accordingly, it is possible to enhance the productivity and the stability of EL element. Further, the present dielectric film can be formed at low temperature, for instance, while controlling the temperature of a substrate in a range of from room temperature to 300° C. Consequently, independent of materials forming a luminous layer, the present dielectric film can be formed on any luminous layer. Furthermore, since the present dielectric film is not a laminated film, but a composite film, it can be prepared without complicating its preparation process. Thus, even from the production engineering viewpoint, the present dielectric film can produce an extra advantage.

In particular, the present dielectric film and an EL element employing the present dielectric film can maintain, regardless of the lamination with a transparent conductive film, a relative dielectric constant and a dielectric breakdown electric field which are inherent to a simple tantalum oxide film or even higher than those of a simple tantalum oxide film. For example, their relative dielectric constant falls in a range of from 17 to 23, and their dielectric breakdown electric field (i.e., a dielectric breakdown strength examined as an electric field causing dielectric breakdown) falls in a range of from 2.4 to 5.5 MV/cm.

Moreover, when the present dielectric film and a simple tantalum oxide film are formed on an identical substrate respectively, the substrate with the present dielectric film formed can exhibit a figure of merit (e.g., the product of a relative dielectric constant and a dielectric breakdown field) which is equal to or even greater than that of the substrate with a simple tantalum oxide film formed thereon. As a result, the problem associated with the preparation of a transparent EL element can be solved. That is, as hereinafter described, four light-emitting surfaces of 10 mm×30 mm in size can be formed on one substrate so as to prepare a transparent EL element which can simultaneously emit light stably for a long period of time. In addition, enlargement of thus prepared element results in further enlargement of substrate, and thereby a light-emitting device having a large area can be prepared.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

In FIGS. 3 to 17, the blank circles (○) represent the values for a dielectric film on a Si substrate, and the solid circles (●) represent the values for a dielectric film on an ITO transparent conductive film/Si substrate.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

The dielectric film according to the present invention was examined for its characteristics. Moreover, the present dielectric film was laminated with a transparent conductive film, and the resulting laminated construction was also examined for its characteristics.

A preferred embodiment of the present dielectric film was prepared by a magnetron simultaneous sputtering process under the following conditions.

For instance, two targets, e.g., a $Ta_2O_5$ target and an additive member target, were disposed simultaneously in a magnetron simultaneous sputtering apparatus. The formation of a film was carried out while adjusting the voltages to be applied to the targets respectively so as to vary the composition of the resulting thin film.

The conditions of the film formation will be detailed hereinafter. As for the targets, oxides were employed. Namely, a $Ta_2O_5$ target was prepared as a source of the Ta atoms, and the following 4 oxide targets were prepared respectively as sources of the additive components (i.e., In, Sn and Zn atoms): an $In_2O_3$ target, an $SnO_2$, a ZnO target, and an ITC target as a source of two additive components (e.g., In and Sn atoms). The ITO target included $In_2O_3$ in an amount of 95% by weight and $SnO_2$ in an amount of 5% by weight. The sputtering gas pressure was adjusted to $1.5\times10^{-3}$ Torr. The residual gas pressure was adjusted to $3\times10^{-6}$ Torr. The sputtering atmosphere was an argon gas which included oxygen in an amount of 30% by volume. The temperature of a substrate was held at room temperature. Under these conditions, the film formation was carried out, thereby preparing a preferred embodiment of the present dielectric film.

As for the substrate, the following substrate is prepared: a single crystal silicon substrate was prepared in a thickness of about 400 micrometers, and an ITO transparent conductive film was formed on the single crystal silicon substrate in a thickness of about 1,200 angstroms (i.e., 0.12 micrometers). The single crystal silicon was an n-type, had Miller indices of planes (100), and exhibited a resistivity of 0.02 ohm-cm. A target for the ITO transparent conductive film included $In_2O_3$ in an amount of 95% by weight and $SnO_2$ in an amount of 5% by weight.

Figure 2:
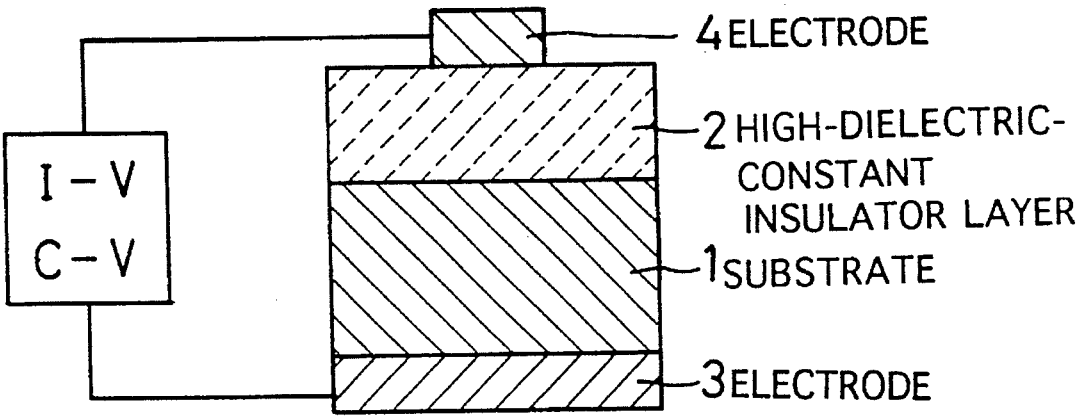
FIG. 2 is a schematic cross-sectional view for illustrating how dielectric films prepared in accordance with a preferred embodiment are examined for their characteristics.

The resulting preferred embodiment of the present dielectric film was built into an MIS (i.e., Metal Insulator Semiconductor) construction whose cross-sectional view is schematically illustrated in FIG. 2. In order to examine the preferred embodiment for its performance, aluminum electrodes were further provided on top and bottom surfaces of the MIS construction, respectively.

Specifically, as its cross-sectional view is schematically illustrated in FIG. 2, the MIS construction includes an n-type Si substrate 1 with Sb doped, a tantalum oxide film 2 formed on a top surface of the substrate 1 and incorporating at least one of the additive components, an ohmic electrode 3 made from aluminum and formed on a bottom surface of the substrate 1 by a vapor deposition process, and a dot electrode 4 made from aluminum and formed on a top surface of the tantalum oxide film 2 by a mask vapor deposition process. The dot electrode 4 was formed in a thickness of about 3,000 angstroms (i.e., 0.3 micrometers) and in an area of about $1.9\times10^{-3}$ $cm^2$.

As illustrated in FIG. 2, an electric circuit is disposed between the aluminum electrodes 3 and 4 so as to determine an I-V (i.e., leak current-voltage) characteristic and a C-V (i.e., capacity-voltage) characteristic of the MIS construction, thereby calculating an electric field and a relative dielectric constant in order to evaluate a dielectric breakdown electric field. The term, "electric field," herein means an electric field which brings about a leak current density of 1 microampere/$cm^2$. The figure of merit was further obtained by calculating the product of a relative dielectric constant and a dielectric breakdown electric field. The I-V characteristic was determined by biasing the aluminum dot electrode 4 (i.e., a gate electrode) to + (i.e., plus).

Except that the substrates to be subjected to the film forming process, the additive components and their amounts were varied, samples Nos. 1 through 38 of the present dielectric film were prepared in accordance with the above-described film forming process. Samples Nos. 1 through 38 included the additive components in the various amounts as set forth in Tables 1 and 2 below. As can be appreciated from Tables 1 and 2, the resulting films prepared as samples Nos. 1 through 38 had a thickness which fell in a range of from 1,230 to 1,910 angstroms (i.e., from 0.123 to 0.191 micrometers). Moreover, the resulting films were examined quantitatively by an EPMA (i.e., electron probe microanalysis) analyzer in terms of their component compositions (or the amounts of the additive components). In addition, films completely free from the additive components were similarly prepared as comparative samples Nos. 1 through 6 as set forth in Table 3 below.

The dielectric film having a thickness as small as approximately 300 angstroms (i.e., 0.03 angstroms) or a thickness as large as approximately 15,000 angstroms (i.e., 1.5 micrometers) were also examined and found to exhibit the characteristics of the present invention.

TABLE 1

| Sample Identification | Type of Substrate | Additive Member | Amount (atomic %) | Film Thickness (angstroms) | $E_{bd}$ (MV/cm) | $\epsilon$ | Figure of Merit |
|---|---|---|---|---|---|---|---|
| No. 1 | Si | ITO | 0.5 | 1870 | 4.0 | 22.4 | 89.6 |
| No. 2 | Si | ITO | 2.1 | 1630 | 5.3 | 22.9 | 121.4 |
| No. 3 | Si | ITO | 12.4 | 1810 | 4.0 | 22.3 | 89.2 |
| No. 4 | Si | ITO | 23.7 | 1830 | 4.2 | 18.9 | 79.4 |
| No. 5 | Si | ITO | 43.5 | 1910 | 4.7 | 18.8 | 88.4 |
| No. 6 | Si | ITO | 71.2 | 1350 | 1.0 | — | — |
| No. 7 | Si | $In_2O_3$ | 16.3 | 1540 | 4.7 | 20.4 | 95.9 |
| No. 8 | Si | $In_2O_3$ | 36.4 | 1270 | 5.3 | 18.6 | 98.6 |
| No. 9 | Si | $In_2O_3$ | 65.7 | 1230 | 1.4 | — | — |
| No. 10 | Si | $SnO_2$ | 0.6 | 1550 | 4.5 | 21.6 | 97.2 |
| No. 11 | Si | $SnO_2$ | 6.1 | 1340 | 3.5 | 21.0 | 73.5 |
| No. 12 | Si | $SnO_2$ | 19.8 | 1410 | 5.2 | 17.9 | 93.1 |
| No. 13 | Si | $SnO_2$ | 35.6 | 1730 | 5.4 | 17.0 | 91.8 |
| No. 14 | Si | $SnO_2$ | 49.9 | 1560 | 0.4 | — | — |
| No. 15 | Si | ZnO | 0.4 | 1830 | 4.6 | 21.3 | 98.0 |
| No. 16 | Si | ZnO | 12.4 | 1750 | 3.9 | 20.6 | 80.0 |
| No. 17 | Si | ZnO | 25.8 | 1820 | 4.2 | 20.3 | 85.3 |
| No. 18 | Si | ZnO | 43.3 | 1690 | 4.0 | 18.6 | 74.4 |
| No. 19 | Si | ZnO | 62.5 | 1780 | 1.2 | — | — |

(Note)
$E_{bd}$: Dielectric Breakdown Electric Field (MV/cm)
$\epsilon$: Relative Dielectric Constant
Figure of Merit: $(E_{bd}) \times (\epsilon)$

TABLE 2

| Sample Identification | Type of Substrate | Additive Member | Amount (atomic %) | Film Thickness (angstroms) | $E_{bd}$ (MV/cm) | $\epsilon$ | Figure of Merit |
|---|---|---|---|---|---|---|---|
| No. 20 | ITO/Si | ITO | 0.5 | 1870 | 3.6 | 22.4 | 80.6 |
| No. 21 | ITO/Si | ITO | 2.1 | 1630 | 4.7 | 22.9 | 107.6 |
| No. 22 | ITO/Si | ITO | 12.4 | 1810 | 2.4 | 22.3 | 53.5 |
| No. 23 | ITO/Si | ITO | 23.7 | 1830 | 3.4 | 18.9 | 64.3 |
| No. 24 | ITO/Si | ITO | 43.5 | 1910 | 3.1 | 18.8 | 58.3 |
| No. 25 | ITO/Si | ITO | 71.2 | 1350 | 0.04 | — | — |
| No. 26 | ITO/Si | $In_2O_3$ | 16.3 | 1540 | 3.8 | 20.4 | 77.5 |
| No. 27 | ITO/Si | $In_2O_3$ | 36.4 | 1270 | 3.5 | 18.6 | 65.1 |
| No. 28 | ITO/Si | $In_2O_3$ | 65.7 | 1230 | 0.08 | — | — |
| No. 29 | ITO/Si | $SnO_2$ | 0.6 | 1550 | 3.5 | 21.6 | 75.6 |

TABLE 2-continued

| Sample Identification | Type of Substrate | Additive Member | Amount (atomic %) | Film Thickness (angstroms) | $E_{bd}$ (MV/cm) | ε | Figure of Merit |
|---|---|---|---|---|---|---|---|
| No. 30 | ITO/Si | $SnO_2$ | 6.1 | 1340 | 2.9 | 21.0 | 60.9 |
| No. 31 | ITO/Si | $SnO_2$ | 19.8 | 1410 | 4.4 | 17.9 | 78.8 |
| No. 32 | ITO/Si | $SnO_2$ | 35.6 | 1730 | 3.8 | 17.0 | 64.6 |
| No. 33 | ITO/Si | $SnO_2$ | 49.9 | 1560 | 0.03 | — | — |
| No. 34 | ITO/Si | ZnO | 0.4 | 1830 | 3.2 | 21.3 | 68.2 |
| No. 35 | ITO/Si | ZnO | 12.4 | 1750 | 2.9 | 20.6 | 59.7 |
| No. 36 | ITO/Si | ZnO | 25.8 | 1820 | 3.1 | 20.3 | 62.9 |
| No. 37 | ITO/Si | ZnO | 43.3 | 1690 | 2.7 | 18.6 | 50.2 |
| No. 38 | ITO/Si | ZnO | 62.5 | 1780 | 0.06 | — | — |

(Note)
$E_{bd}$: Dielectric Breakdown Electric Field (MV/cm)
ε: Relative Dielectric Constant
Figure of Merit: $(E_{bd}) \times (\epsilon)$

TABLE 3

| Comp. Sample Identification | Type of Substrate | Additive Member | Amount (atomic %) | Film Thickness (angstroms) | $E_{bd}$ (MV/cm) | ε | Figure of Merit |
|---|---|---|---|---|---|---|---|
| Comp. Sample No. 1 | Si | — | — | 750 | 2.0 | 22.3 | 44.6 |
| Comp. Sample No. 2 | Si | — | — | 2000 | 2.9 | 24.0 | 69.6 |
| Comp. Sample No. 3 | Si | — | — | 4000 | >2.5 | 25.3 | >63.3 |
| Comp. Sample No. 4 | ITO/Si | — | — | 750 | 0.05 | 22.3 | 1.1 |
| Comp. Sample No. 5 | ITO/Si | — | — | 2000 | 0.05 | 24.0 | 1.2 |
| Comp. Sample No. 6 | ITO/Si | — | — | 4000 | 0.05 | 25.3 | 1.3 |

(Note)
$E_{bd}$: Dielectric Breakdown Electric Field (MV/cm)
ε: Relative Dielectric Constant
Figure of Merit: $(E_{bd}) \times (\epsilon)$ Samples Nos. 1 through 38 as well as comparative samples Nos. 1 through 6 were subjected to the aforementioned examinations, and the results are also summarized in Tables 1, 2 and 3. Moreover, as shown in FIGS. 3 through 7, FIGS. 8 through 12 and FIGS. 13 through 17, the measured values recited in Tables 1, 2 and 3 were plotted on the scatter diagrams of the dielectric breakdown electric fields, the relative dielectric constants and the figures of merit, respectively.

Figure 3:
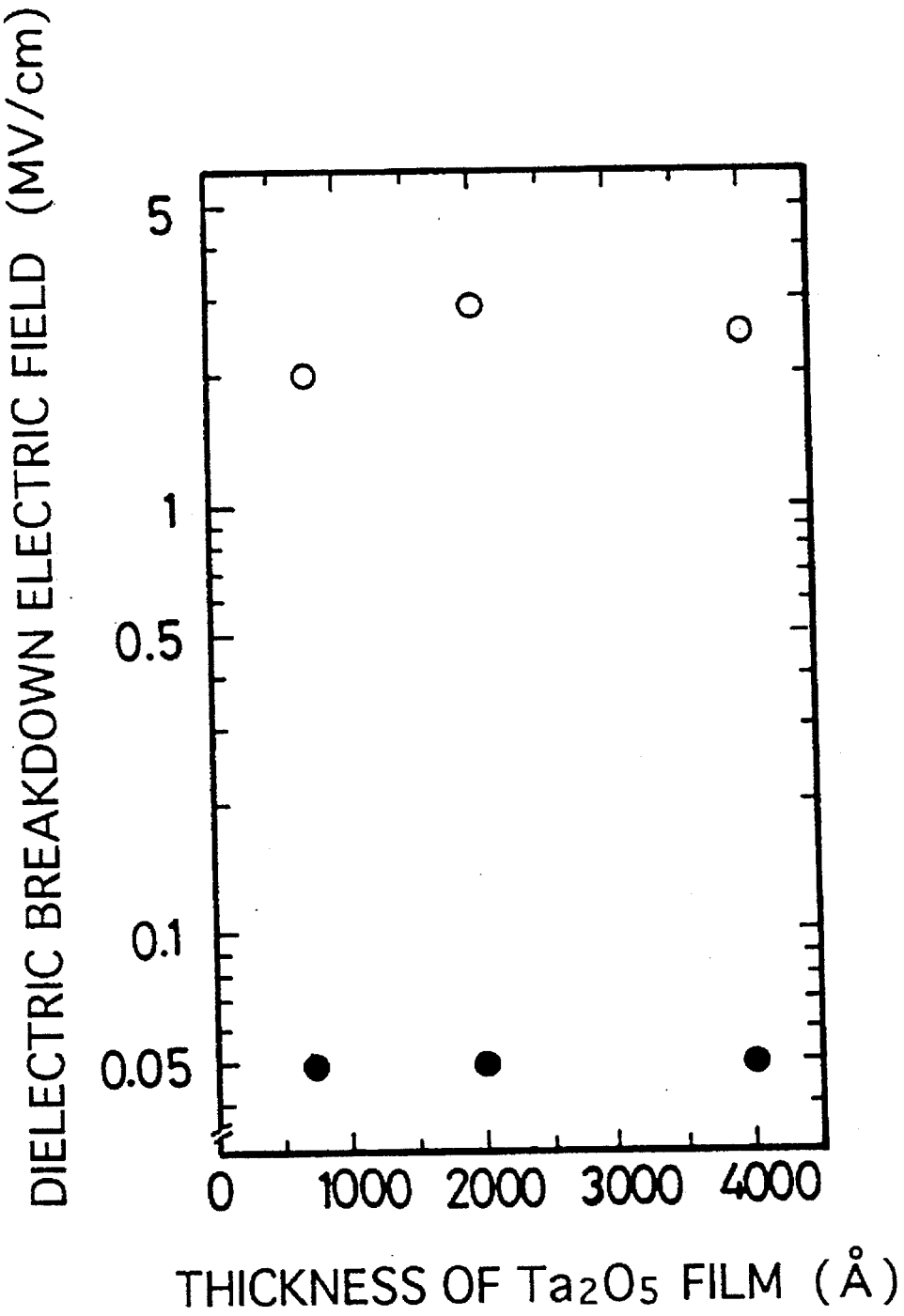
FIG. 3 is a scatter diagram illustrating the relationship between the dielectric breakdown fields exhibited by tantalum oxide films of a comparative example and the thicknesses thereof.
Figure 4:
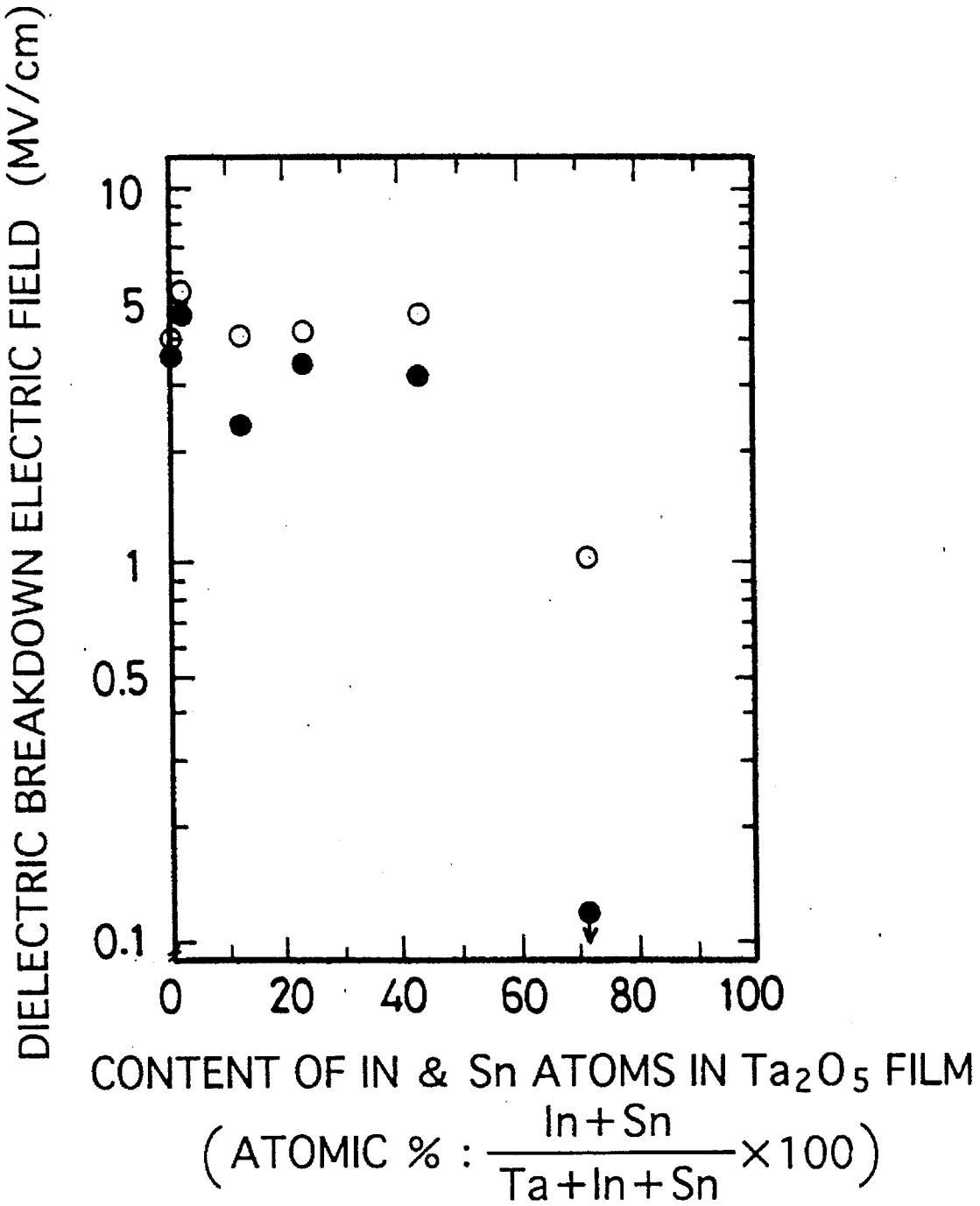
FIG. 4 is a scatter diagram illustrating the relationship between the dielectric breakdown fields exhibited by tantalum oxide films of a preferred embodiment in which ITO was incorporated and the total content of indium and tin atoms incorporated therein.
Figure 5:
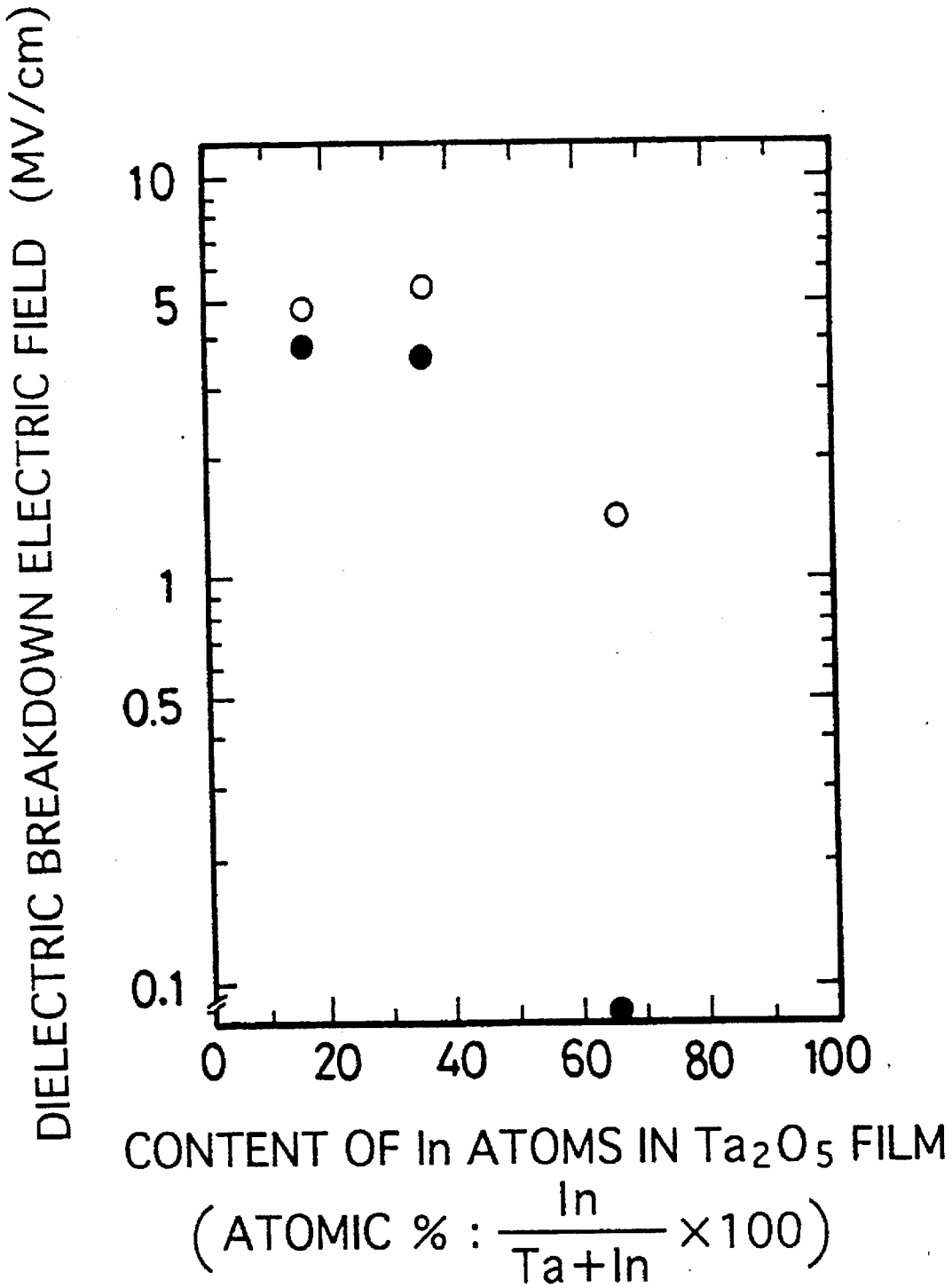
FIG. 5 is a scatter diagram illustrating the relationship between the dielectric breakdown fields exhibited by tantalum oxide films of a preferred embodiment in which indium oxide was incorporated and the content of indium atoms incorporated therein.
Figure 6:
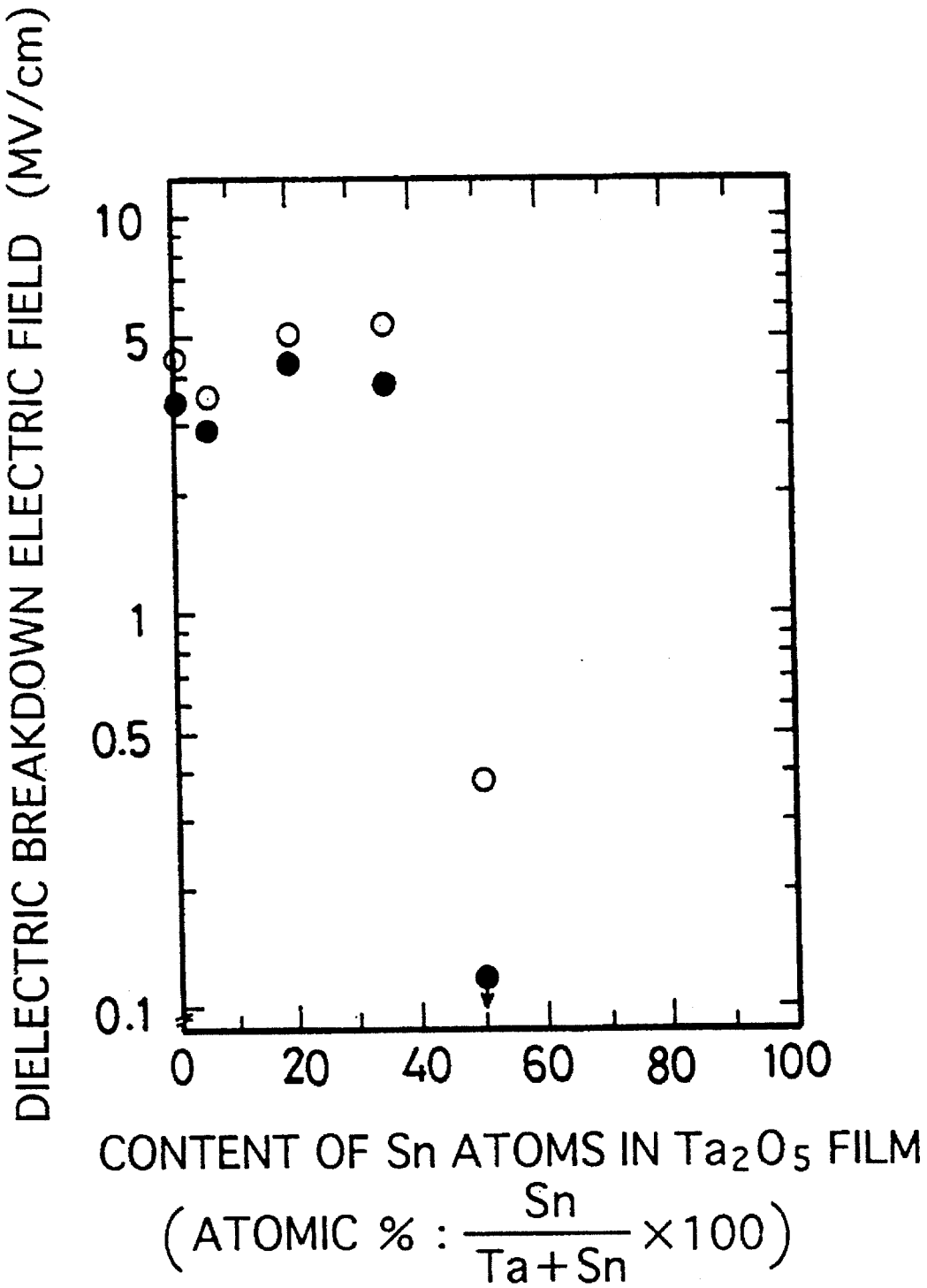
FIG. 6 is a scatter diagram illustrating the relationship between the dielectric breakdown fields exhibited by tantalum oxide films of a preferred embodiment in which tin oxide was incorporated and the content of tin atoms incorporated therein.
Figure 7:
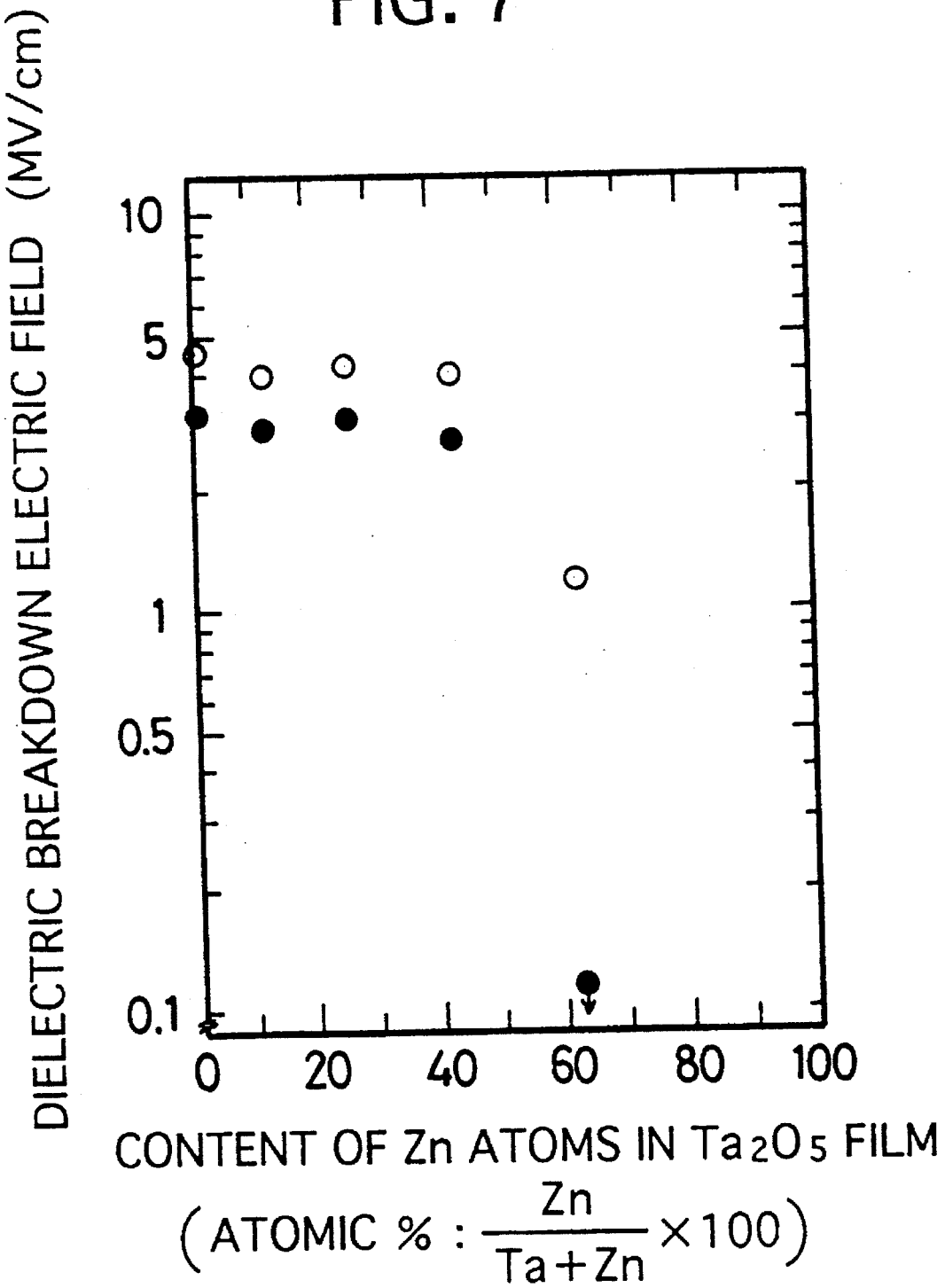
FIG. 7 is a scatter diagram illustrating the relationship between the dielectric breakdown fields exhibited by tantalum oxide films of a preferred embodiment in which zinc oxide was incorporated and the content of zinc atoms incorporated therein.
Figure 8:
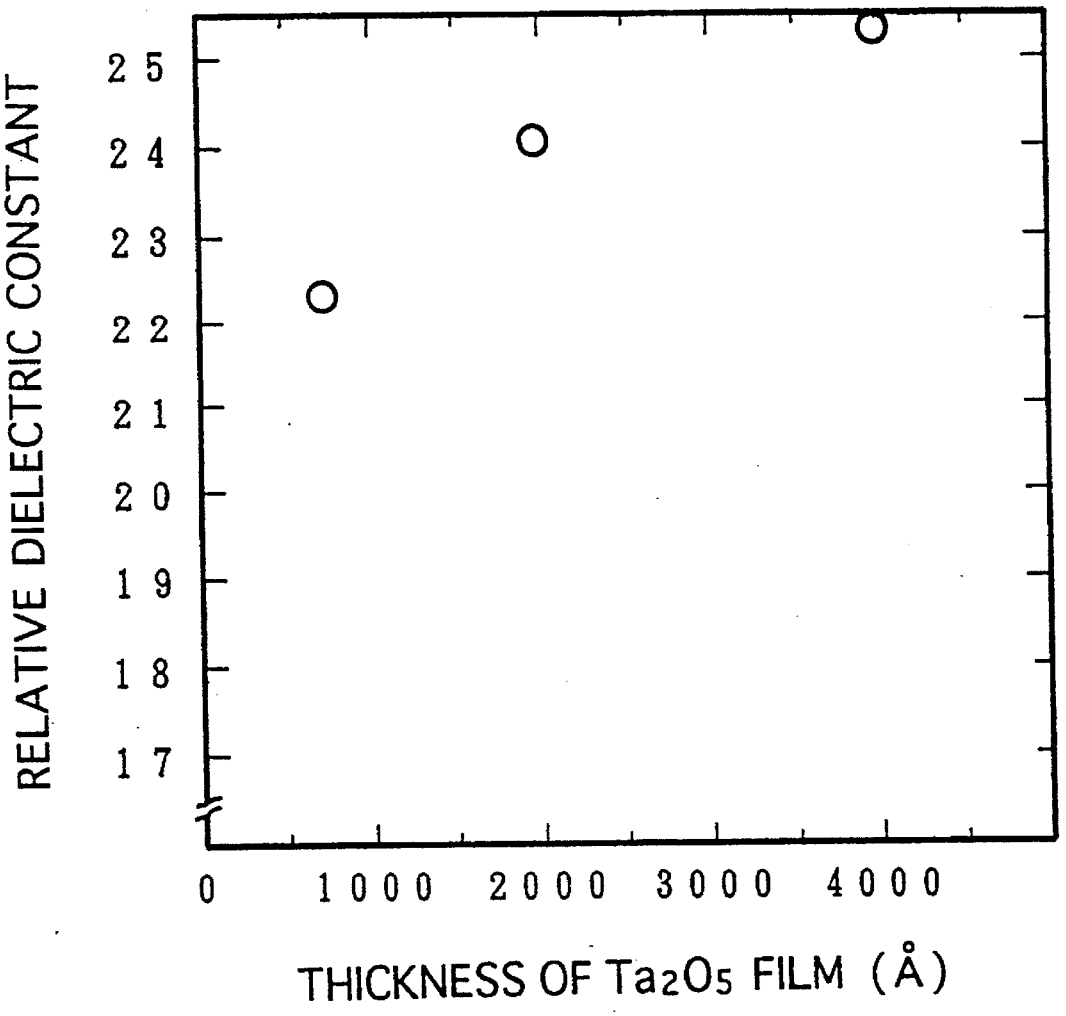
FIG. 8 is a scatter diagram illustrating the relationship between the relative dielectric constants of tantalum oxide films of a comparative example and the thicknesses thereof.
Figure 9:
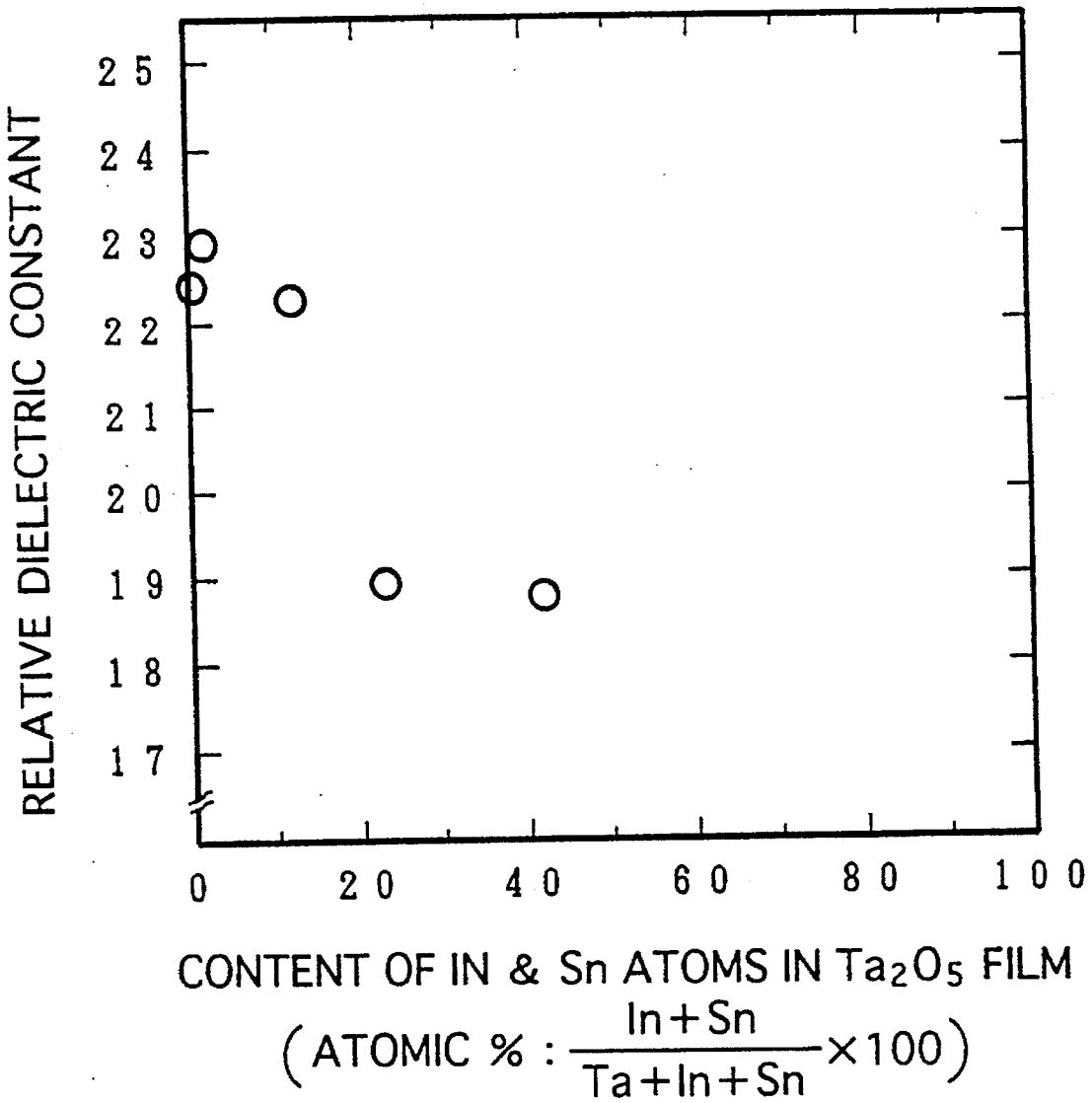
FIG. 9 is a scatter diagram illustrating the relationship between the relative dielectric constants of tantalum oxide films of a preferred embodiment in which ITO was incorporated and the total content of indium and tin atoms incorporated therein.
Figure 10:
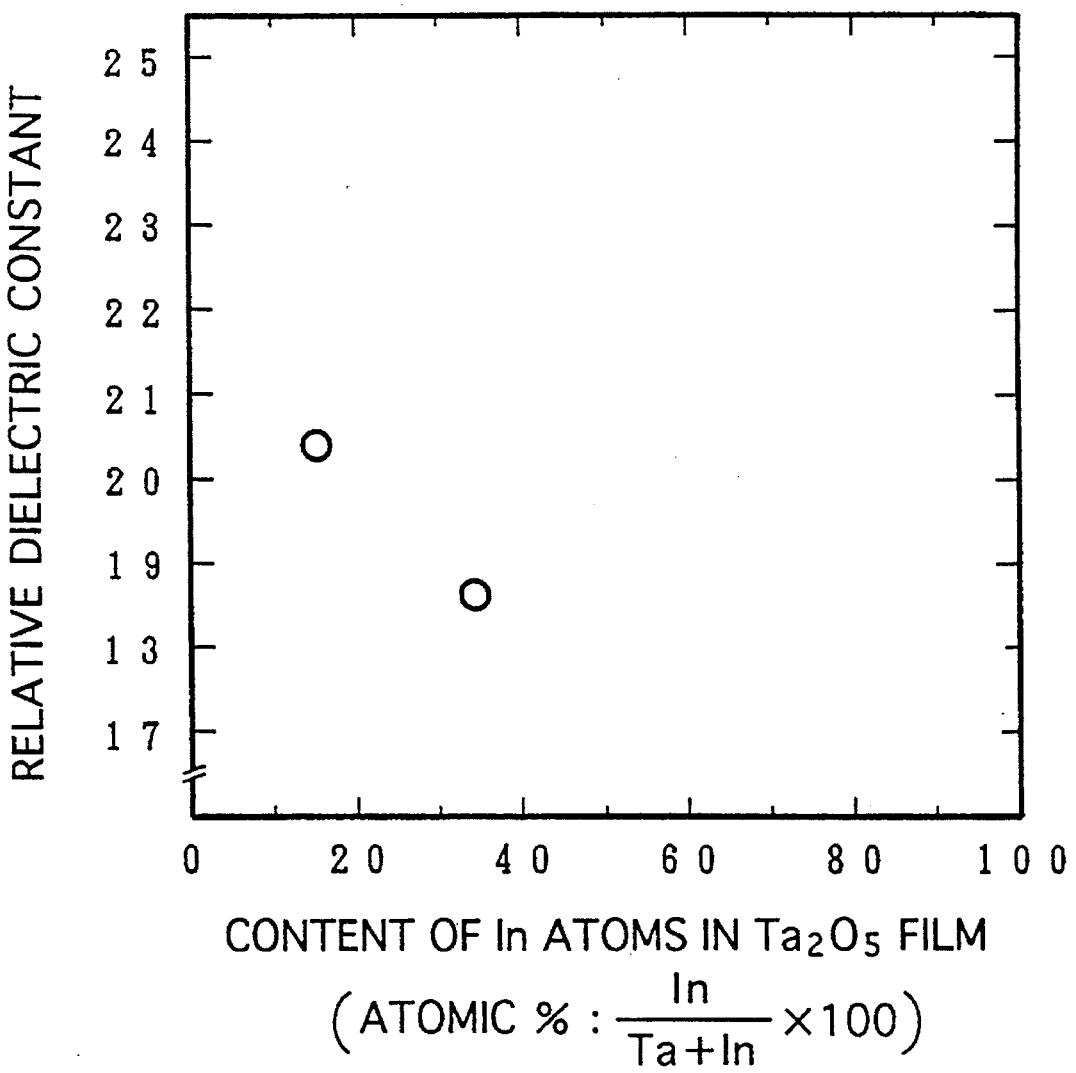
FIG. 10 is a scatter diagram illustrating the relationship between the relative dielectric constants of tantalum oxide films of a preferred embodiment in which indium oxide was incorporated and the content of indium atoms incorporated therein.
Figure 11:
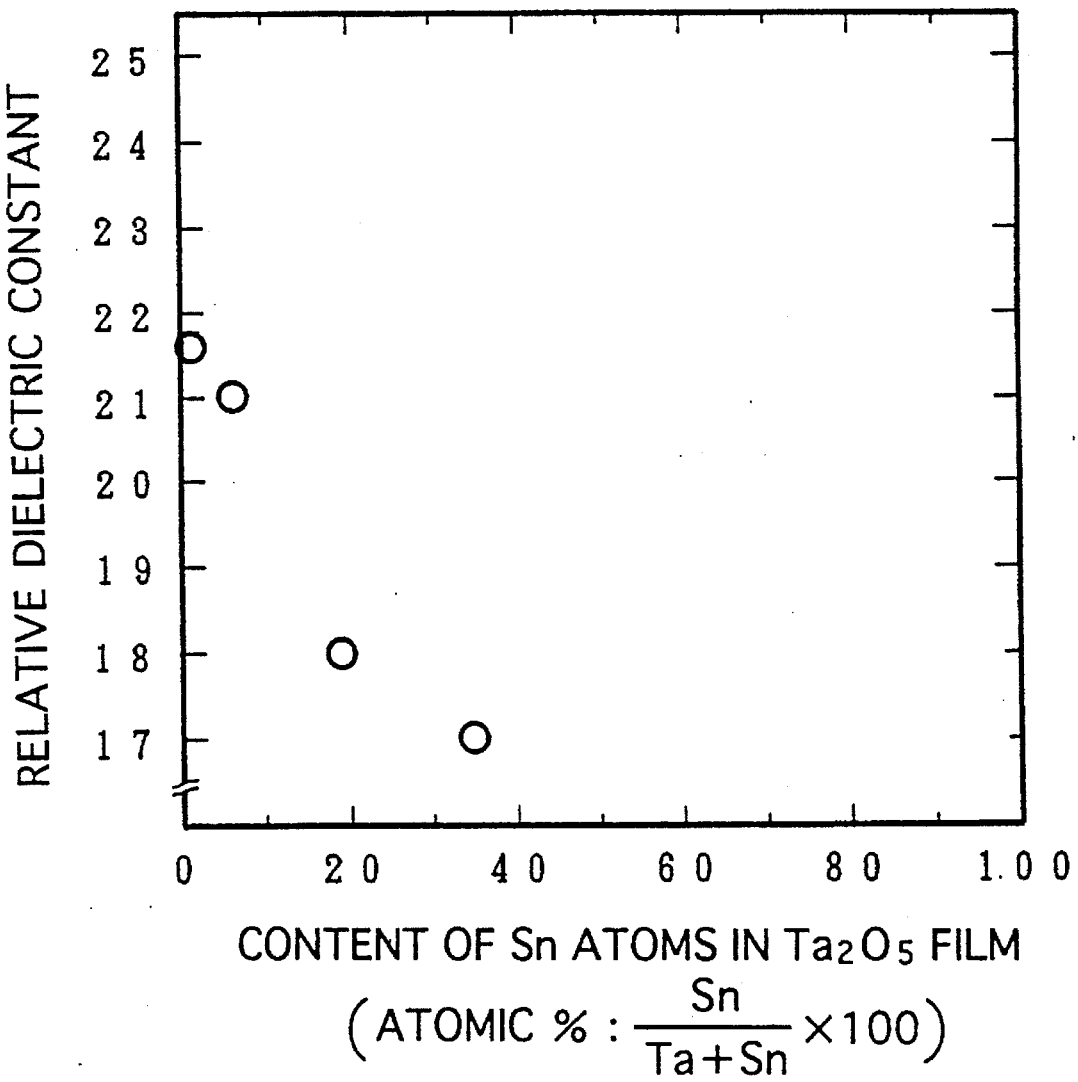
FIG. 11 is a scatter diagram illustrating the relationship between the relative dielectric constants of tantalum oxide films of a preferred embodiment in which tin oxide was incorporated and the content of tin atoms incorporated therein.
Figure 12:
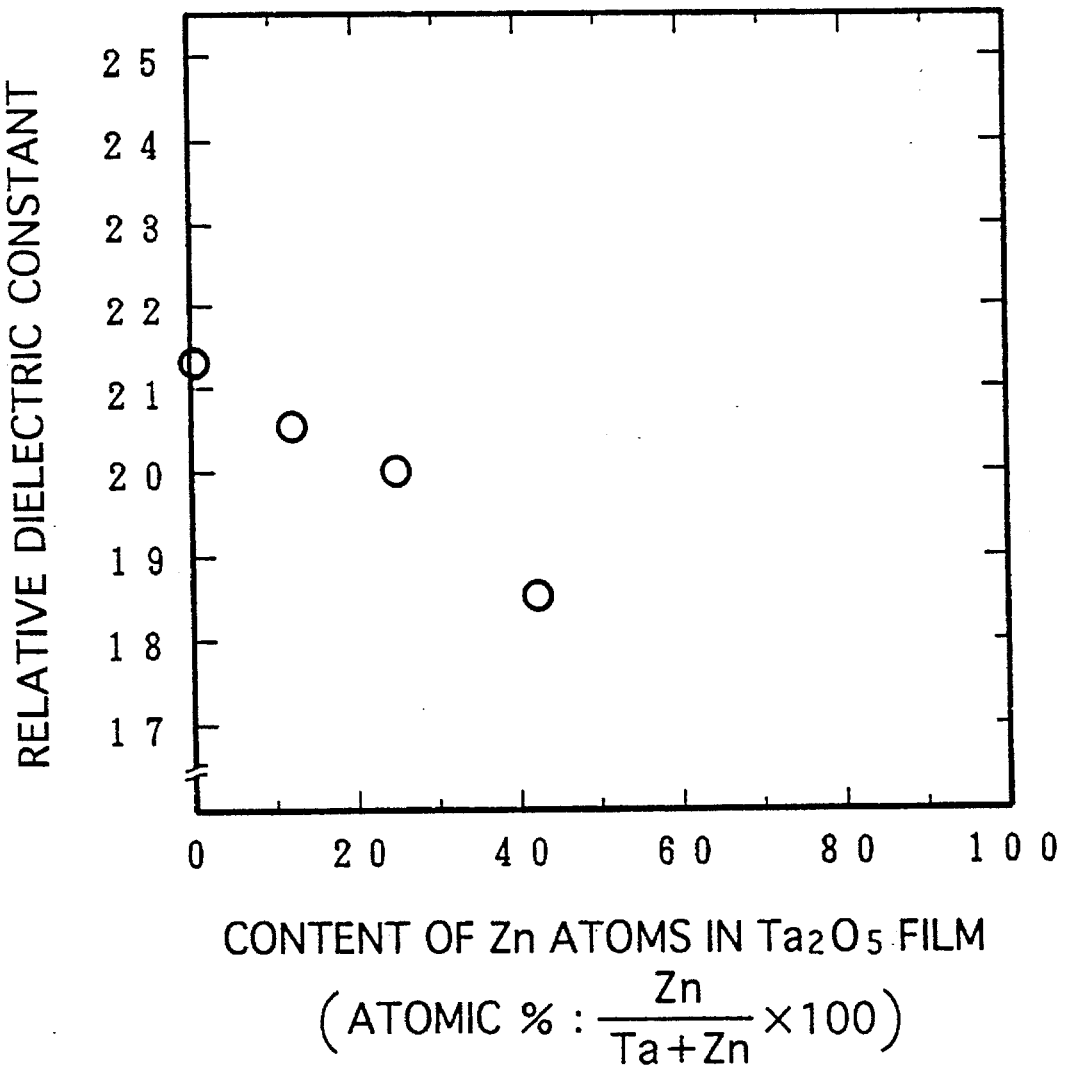
FIG. 12 is a scatter diagram illustrating the relationship between the relative dielectric constants of tantalum oxide films of a preferred embodiment in which zinc oxide was incorporated and the content of zinc atoms incorporated therein.
Figure 13:
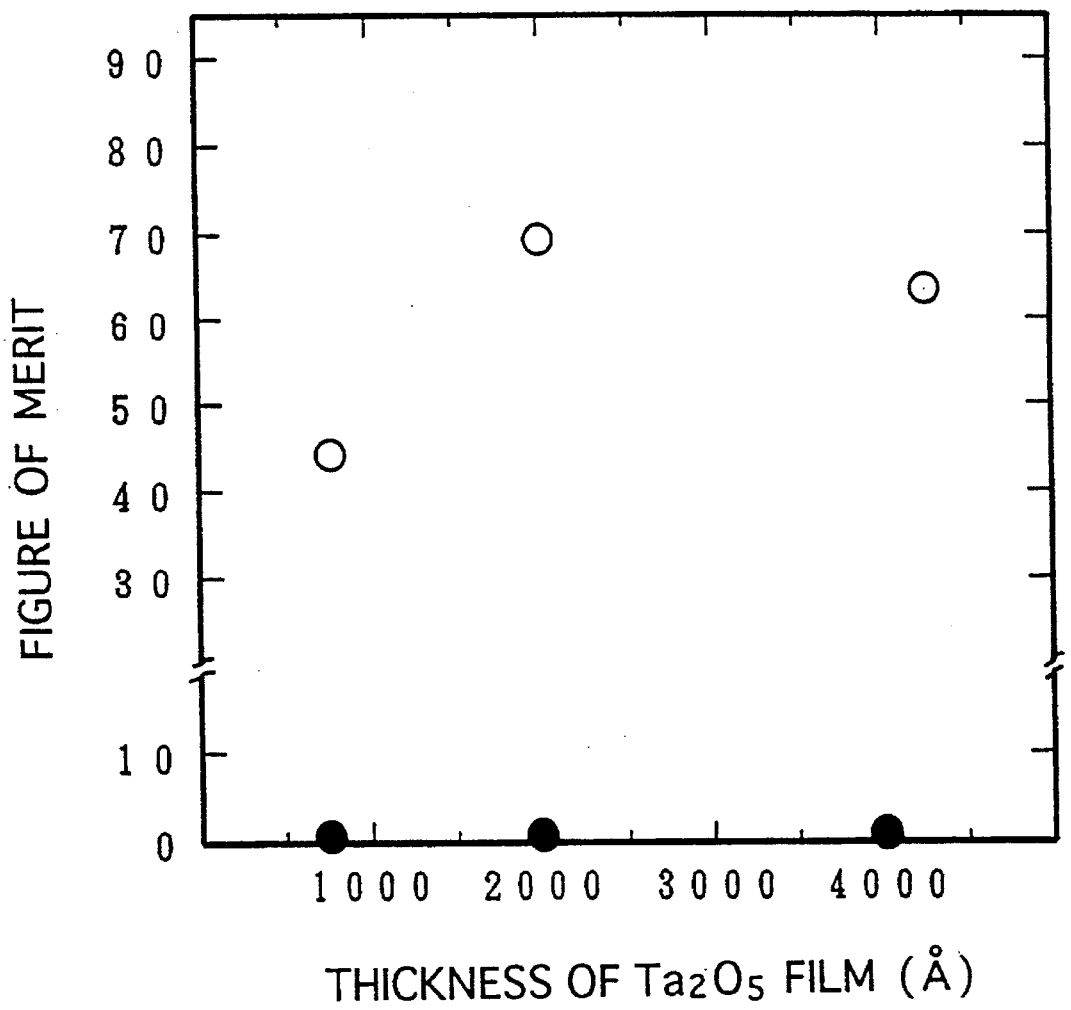
FIG. 13 is a scatter diagram illustrating the relationship between the figures of merit exhibited by tantalum oxide films of a comparative example and the thicknesses thereof.
Figure 14:
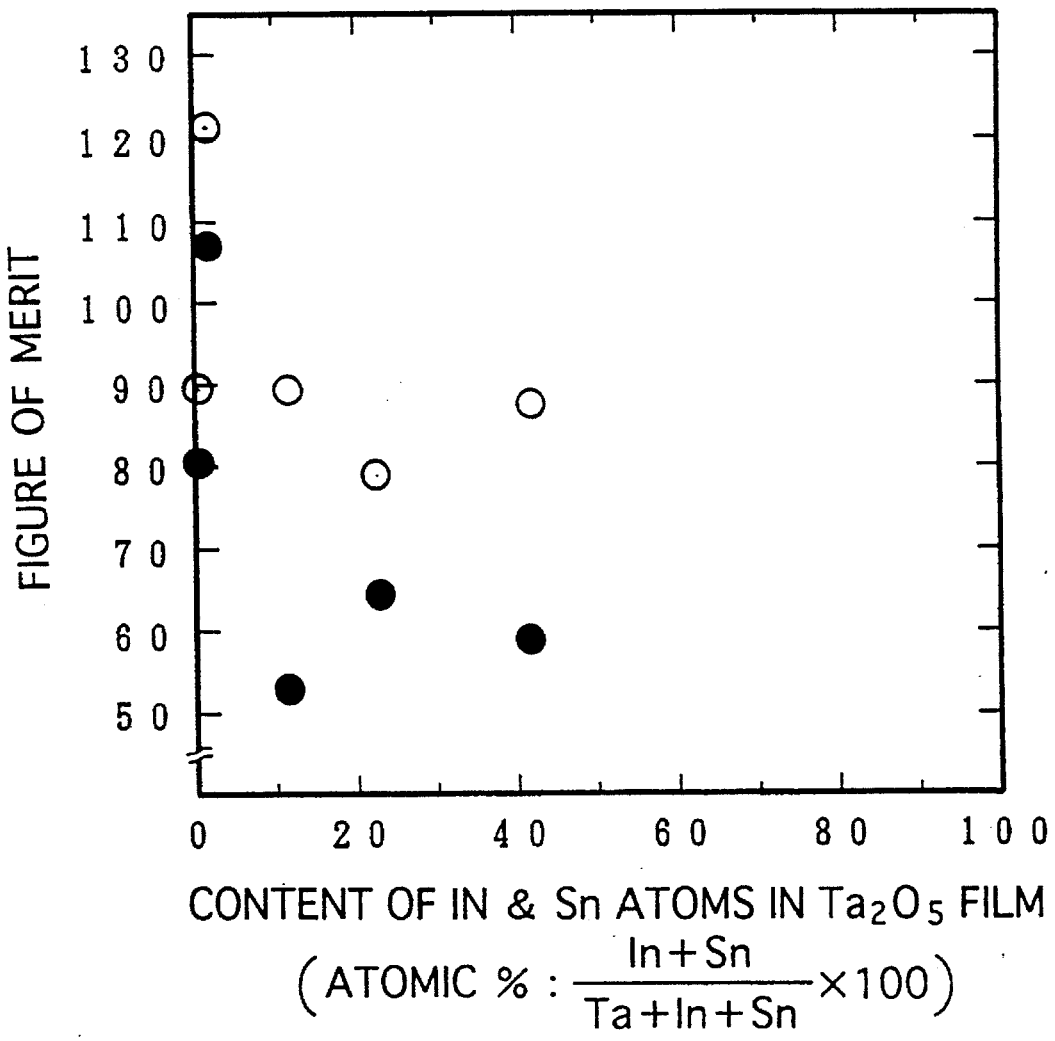
FIG. 14 is a scatter diagram illustrating the relationship between the figures of merit exhibited by tantalum oxide films of a preferred embodiment in which ITO was incorporated and the total content of indium and tin atoms incorporated therein.
Figure 15:
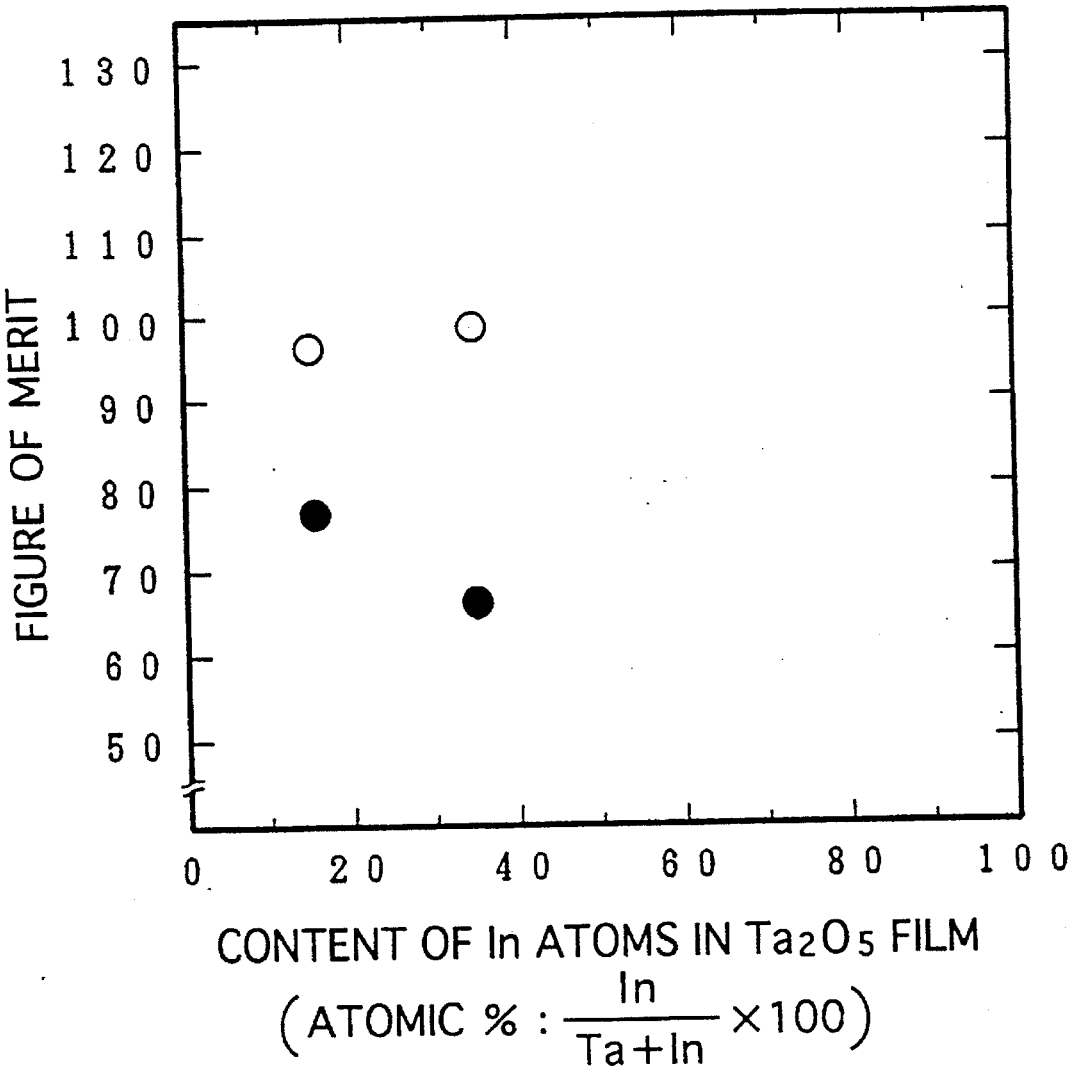
FIG. 15 is a scatter diagram illustrating the relationship between the figures of merit exhibited by tantalum oxide films of a preferred embodiment in which indium oxide was incorporated and the content of indium atoms incorporated therein.
Figure 16:
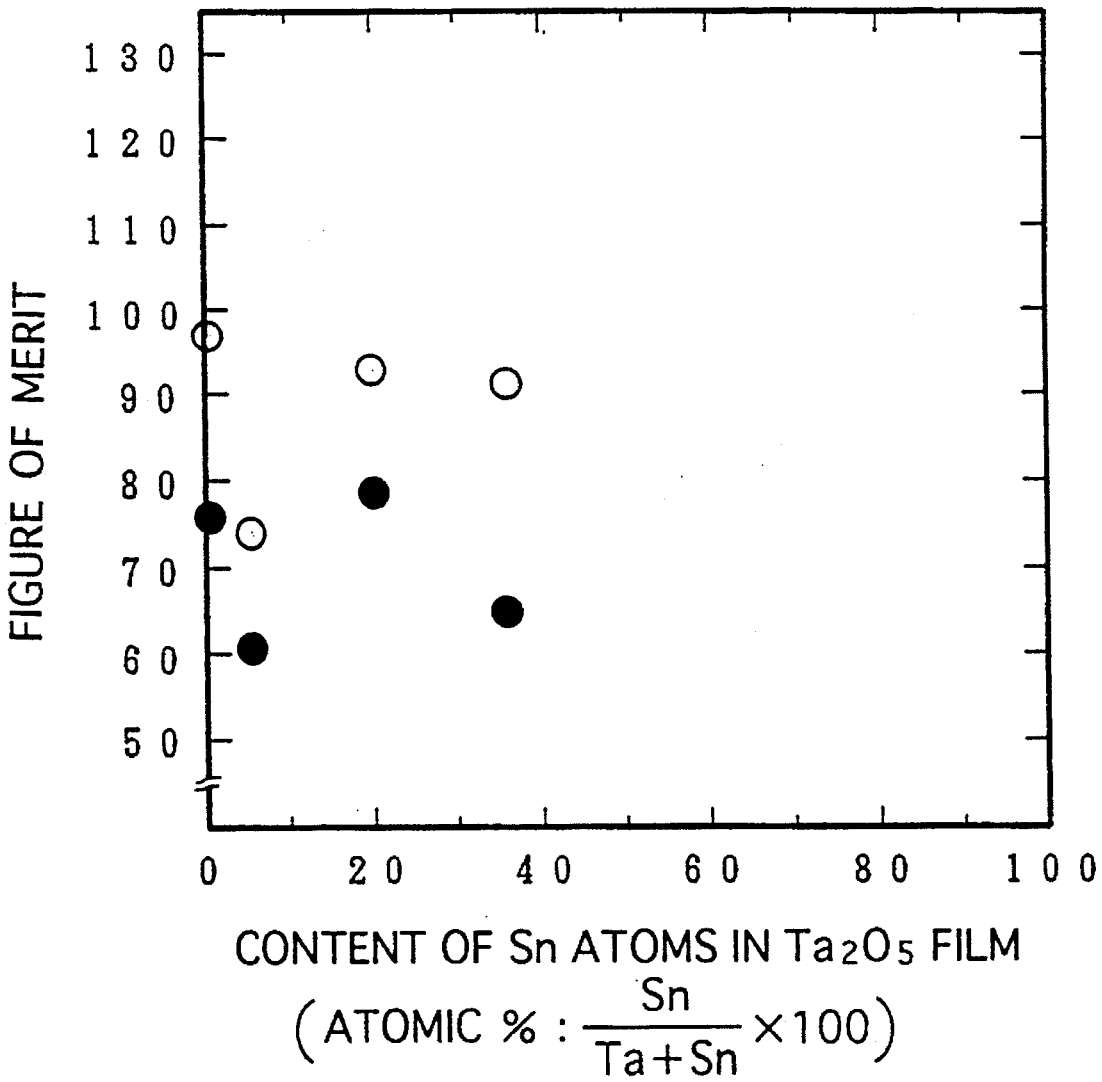
FIG. 16 is a scatter diagram illustrating the relationship between the figures of merit exhibited by tantalum oxide films of a preferred embodiment in which tin oxide was incorporated and the content of tin atoms incorporated therein.
Figure 17:
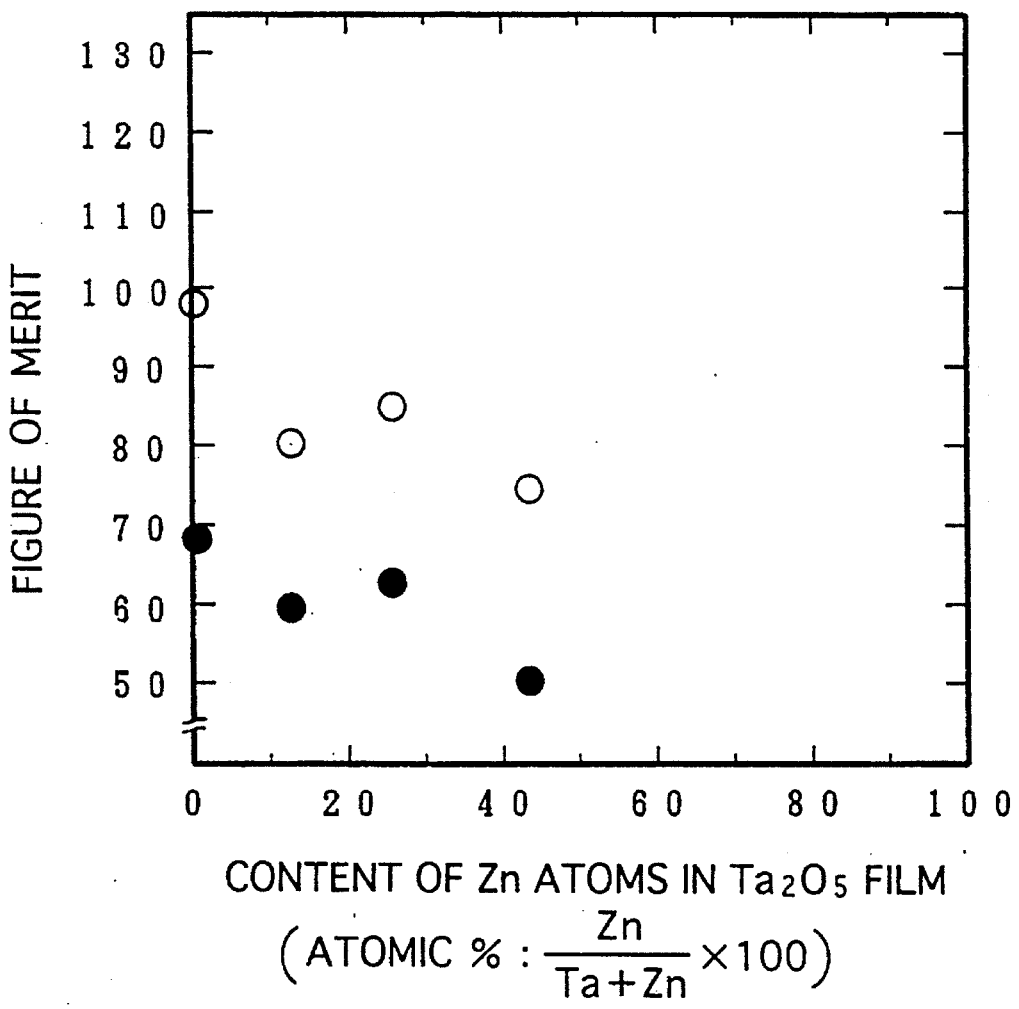
FIG. 17 is a scatter diagram illustrating the relationship between the figures of merit exhibited by tantalum oxide films of a preferred embodiment in which zinc oxide was incorporated and the content of zinc atoms incorporated therein.

As can be seen from FIG. 3, when the films were made from simple tantalum oxide and were formed on the metallic substrates made from silicon (e.g., comparative samples Nos. 1 through 3) as set forth in Table 3, the films exhibited, regardless of their thicknesses, high dielectric breakdown fields which were virtually constant. Further, as can be appreciated from FIG. 8, they had relative dielectric constants which increased as the increment of their thicknesses. Furthermore, as can be understood from FIG. 13, they indeed exhibited relatively large figures of merit. (See blank circles (o) in each Figure.)

On the other hand, as can be seen from FIGS. 4, 5, 6 and 7, when the films were made by including at least one of ITO, $In_2O_3$, $SnO_2$ and ZnO in tantalum oxide and were formed on the metallic substrates made from silicon (e.g., samples Nos. 1 through 19) as set forth in Table 1, the films made from tantalum oxide with ITO, the films made from tantalum oxide with $In_2O_3$, the films made from tantalum oxide with $SnO_2$, and the films made from tantalum oxide with ZnO, respectively, exhibited dielectric breakdown electric fields which was at the same level as those of the simple tantalum oxide films or higher. In FIGS. 4, 5, 6 and 7, the blank circles (o) specify the dielectric breakdown electric fields which were exhibited by the films made from tantalum oxide with at least one of the additive components (e.g., In, Sn and Zn atoms), and formed on the Si substrate. It should be noted, however, that these films exhibited the dielectric breakdown fields which decreased generally when the amount of the additive components exceeded 60 atomic %. Thus, it is preferred that the amount of the additive components is 55.0 atomic % or less.

Further, FIGS. 9, 10, 11 and 12 are scattering diagrams illustrating the relationships between the relative dielectric constants and the amounts of at least one of ITO, $In_2O_3$, $SnO_2$ and ZnO in tantalum oxide, relationships which were exhibited by the films made from tantalum oxide with ITO, the films made from tantalum oxide with $In_2O_3$, the films made from tantalum oxide with $SnO_2$, and the films made from tantalum oxide with ZnO, respectively. Although the preferred embodiments of the present film did not necessarily have the thicknesses which were identical to those of the simple tantalum oxide films, most of them had the relative dielectric constants which were substantially equivalent to those of the simple tantalum oxide films. A very few of them had the relative dielectric constants which were just slightly smaller than those of the simple oxide tantalum oxide films.

The relative dielectric constants are plotted only by blank circles (o) (and not by solid circles) to represent the values for dielectric films both on a Si substrate and an ITO transparent conductive film/Si substrate, since such values are identical.

Furthermore, FIGS. 14, 15, 16 and 17 are scattering diagrams illustrating the relationships between the figures of merit and the amounts of at least one of ITO, $In_2O_3$, $SnO_2$ and ZnO in tantalum oxide, relationships which were exhibited by the films made from tantalum oxide with ITO, the films made from tantalum oxide with $In_2O_3$, the films made from tantalum oxide with $SnO_2$, and the films made from tantalum oxide with ZnO, respectively. In FIGS. 14, 15, 16 and 17, the blank circles (o) specify the figures of merit which were exhibited by the films made from tantalum oxide with at least one of the additive components (e.g., In, Sn and Zn atoms), and formed on the Si substrate. Concerning the figure of merit, all of the preferred embodiments of the present dielectric film exhibited values which were greater than those of the simple oxide tantalum oxide films (e.g., comparative examples Nos. 1 through 3). Thus, as can be appreciated from FIGS. 14, 15, 16 and 17, the preferred embodiments of the present dielectric film were superior to the simple tantalum oxide film in terms of the dielectric breakdown strength and the relative dielectric constant.

Moreover, when the ITO transparent conductive film was formed on the Si substrate and the simple tantalum oxide film was formed on the top surface of the ITO transparent conductive film (e.g., comparative examples Nos. 4 through 6) as set forth in Table 3, the MIS constructions exhibited considerably deteriorated dielectric breakdown electric fields as specified with solid circles (●) in FIG. 3. Although they did not have degraded relative dielectric constants, they exhibited the figures of merit which were decreased remarkably as specified with solid circles (●) in FIG. 13.

On the contrary, as can be seen from FIGS. 4, 5, 6 and 7, when the ITO transparent conductive film was formed on the Si substrate, and when the films were made by incorporating at least one of ITO, $In_2O_3$, $SnO_2$ and ZnO in tantalum oxide and were formed on the top surface of the ITO transparent film (e.g., samples Nos. 20 through 38) as set forth in Table 2, the films made from tantalum oxide with ITO, the films made from tantalum oxide with $In_2O_3$, the films made from tantalum oxide with $SnO_2$, and the films made from tantalum oxide with ZnO, respectively, exhibited dielectric breakdown electric fields which were invariably and substantially as high as those of the films formed directly on the Si substrate (e.g., samples Nos. 1 through 19). In FIGS. 4, 5, 6 and 7, the solid circles (●) specify the dielectric breakdown electric fields which were exhibited by the films made from tantalum oxide with at least one of the additive components (e.g., In, Sn and Zn atoms), and formed on the top surface of the ITO transparent conductive film.

Moreover, since these films did have the relative dielectric constants which little varied with respect to those of samples Nos. 1 through 19, they kept exhibiting the high figures of merit as illustrated in FIGS. 14, 15, 16 and 17 which are scattering diagrams illustrating the relationships between the figures of merit and the amounts of at least one of ITO, $In_2O_3$, $SnO_2$ and ZnO in tantalum oxide. The relationships were exhibited by the films made from tantalum oxide with ITO, the films made from tantalum oxide with $In_2O_3$, the films made from tantalum oxide with $SnO_2$, and the films made from tantalum oxide with ZnO, respectively. In FIGS. 14, 15, 16 and 17, the solid circles (●) specify the figures of merit which were exhibited by the films made from tantalum oxide with at least one of the additive components (e.g., In, Sn and Zn atoms), and formed on the top surface of the ITO transparent conductive film.

According to the results of the examination described above, it is understood that the present dielectric film can be improved over the simple tantalum oxide film in terms of the figure of merit by incorporating at least one of the additive members (e.g., ITO, $In_2O_3$, $SnO_2$ and ZnO) in tantalum oxide. It is also appreciated that, even when the present dielectric film is laminated on a transparent conductive film, the present dielectric film is little deteriorated in terms of the dielectric breakdown electric field, and accordingly it can keep exhibiting a figure of merit as high as possible.

Regarding the amount of at least one of the additive components (e.g., In, Sn and Zn atoms) in tantalum oxide, it is scarcely affected by the elements to be added, but it is preferred to be 55.0 atomic % or less with respect to a total content of Ta and at least one of In, Sn and Zn, constituting the present dielectric film. Considering the practical values of the relative dielectric constant and the dielectric breakdown electric field, the amount was verified to further preferably fall in the range of from 0.4 to 45.0 atomic % with respect thereto.

Second Preferred Embodiment

The second preferred embodiment of the present dielectric film will be hereinafter described. Specifically, in the second preferred embodiment, the present dielectric film is laminated with a transparent conductive film, and thereby it is applied to an EL element.

Figure 1:
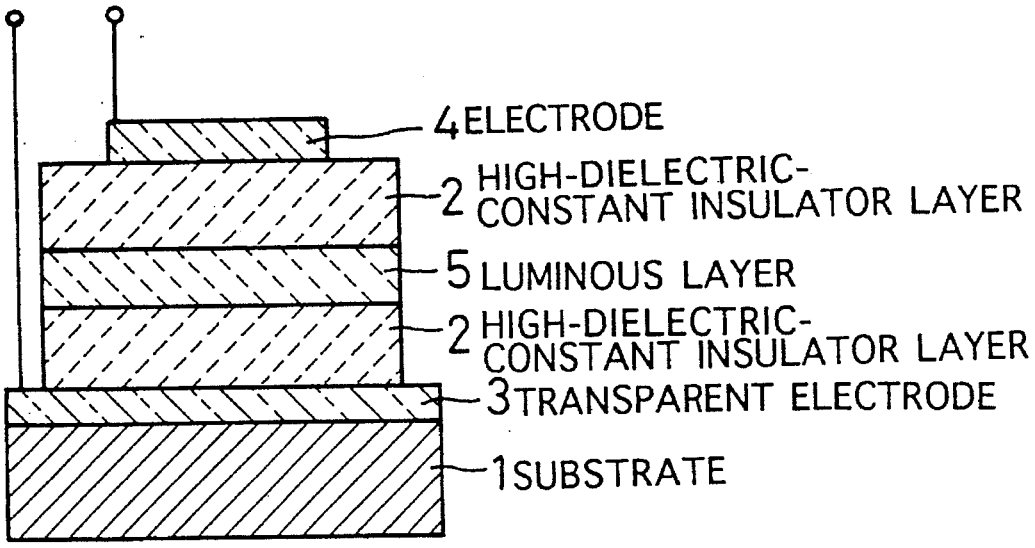
FIG. 1 is a schematic cross-sectional view of a construction of an EL element of a preferred embodiment according to the present invention.

A tantalum oxide thin film involving $In_2O_3$ according to the present invention were prepared, and it was used to construct an EL element whose cross-sectional view is schematically illustrated in FIG. 1.

For instance, the EL element illustrated in FIG. 1 was prepared in the following manner. An ITO transparent conductive film 3 working as an electrode was prepared in a thickness of about 1,200 angstroms (i.e., 0.12 micrometers) on a glass substrate 1. A tantalum oxide film 2 incorporating $In_2O_3$ (i.e., the present dielectric film having a high dielectric constant) was prepared by a sputtering process. In the sputtering process, two sintered oxide targets, for example, an $In_2O_3$ target and a $Ta_2O_5$ target, were used to carry out a 2-way simultaneous sputtering process. The powers supplied to the targets were controlled so that the ratio of the content of the In atoms were about 15 atomic % with respect to the total content of the In atoms and the Ta atoms in the resulting tantalum oxide film 2. Moreover, when forming the tantalum oxide film 2 having a high dielectric constant, since oxygen could not be sufficiently taken in the tantalum oxide film 2, an argon gas including oxygen in an amount of 30% by volume was used to compensate the oxygen insufficiency and the temperature of the glass substrate 1 was held at 200° C. The resulting tantalum oxide film 2 had a thickness of about 3,000 angstroms (i.e., 0.3 micrometers). Furthermore, the thickness of the film having a high dielectric constant was varied from 1,000 angstroms (i.e., 0.1 micrometers) to 5,000 angstroms (i.e., 0.5 micrometers), but the insulatability was not affected. Note that, excepting these conditions, the tantalum oxide film 2 was prepared under the same conditions as set forth in the "First Preferred Embodiment" section.

Further, a luminous layer 5 was formed on the top surface of the tantalum oxide film 2 having a high dielectric constant in the following manner. The luminous layer 5 was made from ZnS doped with Sm which emits reddish orange light, and it was formed as a thin film having a thickness of about 3,000 angstroms (i.e., 0.3 micrometers) in an argon gas while holding the temperature of the glass substrate 1 at 200° C.

Furthermore, another tantalum oxide film 2 (i.e., the present dielectric film having a high dielectric constant) was formed on the top surface of the luminous layer 5 under the same conditions as described for the aforementioned tantalum oxide film 2.

Finally, an aluminum electrode 4 working as an upper electrode was formed in a thickness of about 3,000 angstroms (i.e., 0.3 micrometers ) by a vacuum deposition process. A whole-solid type EL element was thus prepared. Note that this EL element was prepared to include four light-emitting surfaces, each of which had an area of 10 mm×30 mm, with respect to one substrate.

This EL element emitted reddish orange light in a room-temperature atmosphere when it was subjected to a voltage of 130 V in an electric field of 1 KHz frequency, and the four light-emitting surfaces thereof could simultaneously emit the light stably for a long period of time (e.g., 3 months or more). Thus, this EL element was remarkably improved over the conventional EL element in terms of longevity. Note that, in the conventional EL element, either one of its light-emitting surfaces suffers from the dielectric breakdown on the day of the preparation or in a couple of days thereafter when the conventional EL element is subjected to a durability test.

Having now fully described the present invention, it will be apparent to one of ordinary skill in the art that many changes and modifications can be made thereto without departing from the spirit or scope of the present invention as set forth herein including the appended claims.

What is claimed is:

1. An electroluminescent element comprising a dielectric film, said dielectric film comprising:

tantalum oxide; and at least one metal oxide selected from the group consisting of indium oxide and tin oxide, being incorporated in said tantalum oxide, said dielectric film being formed as a thin film, and the content of metal atoms in said at least one metal oxide being 55 atomic % or less with respect to the total content of metal atoms in said tantalum oxide and said at least one metal oxide.

2. The electroluminescent element according to claim 1, wherein the content of metal atoms in said at least one metal oxide falls in a range of from 0.4 to 45.0 atomic % with respect to the total content of metal atoms in said tantalum oxide and said at least one metal oxide.

3. The dielectric film according to claim 1, wherein said electroluminescent element has a thickness of from 0.03 to 1.5 micrometers.

4. The dielectric film according to claim 3, wherein said electroluminescent element has a thickness of from 0.1 to 0.5 micrometers.

5. An electroluminescent element comprising a dielectric film, said dielectric film comprising:

tantalum oxide; and zinc oxide incorporated in said tantalum oxide, said dielectric film being formed as a thin film, and the content of metal atoms in said zinc oxide being 55 atomic % or less with respect to the total content of metal atoms in said tantalum oxide and said zinc oxide.

6. The electroluminescent element according to claim 5, wherein the content of metal atoms in said zinc oxide falls in a range of from 0.4 to 45.0 atomic % with respect to the total content of metal atoms in said tantalum oxide and said zinc oxide.

7. The dielectric film according to claim 5, wherein said electroluminescent element has a thickness of from 0.03 to 1.5 micrometers.

8. The dielectric film according to claim 7, wherein said electroluminescent element has a thickness of from 0.1 to 0.5 micrometers.

9. An electroluminescent element, comprising:

a luminous layer having opposed surfaces;

a first dielectric layer coated on one of said opposed surfaces;

a second dielectric layer coated on the other of said opposed surfaces;

a transparent electrode disposed on said first dielectric layer; and a backing electrode disposed on said second dielectric layer, at least one of said first and second dielectric layers comprising tantalum oxide, and at least one member selected from the group consisting of indium oxide and tin oxide being incorporated in said tantalum oxide, said at least one of said first and second dielectric layers being formed as a thin film, and the content of metal atoms in said at least one metal oxide being 55 atomic % or less with respect to the total content of metal atoms in said tantalum oxide and said at least one metal oxide.

10. The electroluminescent element according to claim 9, wherein the content of metal atoms in said at least one metal oxide falls in a range of from 0.4 to 45.0 atomic % with respect to the total content of metal atoms in said tantalum oxide and said at least one metal oxide.

11. The electroluminescent element according to claim 9, wherein said at least one of the first and second dielectric films has a thickness of from 0.03 to 1.5 micrometers.

12. The electroluminescent element according to claim 11, wherein said at least one of the first and second dielectric films has a thickness of from 0.1 to 0.5 micrometers.

13. An electroluminescent element, comprising:

a luminous layer having opposed surfaces;

a first dielectric layer coated on one of said opposed surfaces; and a second dielectric layer coated on the other of said opposed surfaces;

a transparent electrode disposed on said first dielectric layer; and a backing electrode disposed on said second dielectric layer, at least one of the first and second dielectric layers comprising tantalum oxide, and zinc oxide being incorporated in said tantalum oxide, said at least one of the first and second dielectric layers being formed as a thin film, and the content of metal atoms in said zinc oxide being 55 atomic % or less with respect to the total content of metal atoms in said tantalum oxide and said zinc oxide.

14. The electroluminescent element according to claim 13, wherein the content of zinc atoms in said zinc oxide falls in a range of from 0.4 to 45.0 atomic % with respect to the total content of metal atoms in said tantalum oxide and said zinc oxide.

15. The electroluminescent element according to claim 13, wherein said at least one of the first and second dielectric layers has a thickness of from 0.03 to 1.5 micrometers.

16. The electroluminescent element according to claim 15, wherein said at least one of the first and second dielectric layers has a thickness of from 0.1 to 0.5 micrometers.

* * * * *

UNITED STATES PATENT AND TRADEMARK OFFICE

CERTIFICATE OF CORRECTION

PATENT NO. : 5,589,733

DATED : December 31, 1996

INVENTOR(S) : Koji NODA, et al.

It is certified that error appears in the above-indentified patent and that said Letters Patent is hereby corrected as shown below:

Column 15, line 40, "dielectric film" should read --electroluminescent element--.

line 41, "electroluminescent element" should read --dielectric film--.

line 43, "dielectric film" should read --electroluminescent element--.

line 44, "electroluminescent element" should read --dielectric film--.

line 59, "dielectric film" should read --electroluminescent element--.

line 60, "electroluminescent element" should read --dielectric film--.

UNITED STATES PATENT AND TRADEMARK OFFICE

CERTIFICATE OF CORRECTION

PATENT NO. : 5,589,733

DATED : December 31, 1996

INVENTOR(S) : Koji NODA, et al.

It is certified that error appears in the above-indentified patent and that said Letters Patent is hereby corrected as shown below:

line 62, "dielectric film" should read --electroluminescent element--.

line 63, "electroluminescent element" should read --dielectric film--.

Signed and Sealed this

Fourteenth Day of October, 1997

*Attest:*

*Attesting Officer*

BRUCE LEHMAN

*Commissioner of Patents and Trademarks*